United States Patent [19]

Schmid et al.

[11] Patent Number: 4,718,616

[45] Date of Patent: Jan. 12, 1988

[54] WINDING APPARATUS FOR FORMING LAPS

[75] Inventors: Rene Schmid, Niederneunforn, Switzerland; Hermann Krehl, Karlsruhe, Fed. Rep. of Germany

[73] Assignee: Rieter Machine Works Limited, Winterthur, Switzerland

[21] Appl. No.: 902,660

[22] Filed: Sep. 2, 1986

Related U.S. Application Data

[62] Division of Ser. No. 657,352, Oct. 3, 1984, Pat. No. 4,637,565.

[30] Foreign Application Priority Data

Oct. 10, 1983 [CH] Switzerland ..... 5506/83

[51] Int. Cl.[4] ..... B30B 3/04; B65H 18/06

[52] U.S. Cl. ..... 242/55.1; 100/171; 242/66

[58] Field of Search ..... 242/55.1, 66; 226/189, 226/194; 100/161, 168–171

[56] References Cited

U.S. PATENT DOCUMENTS

| | | | |
|---|---|---|---|
| 659,116 | 10/1900 | White | 100/169 X |
| 2,138,397 | 11/1938 | Cannity | 100/170 X |
| 2,141,315 | 12/1938 | Putnam | 100/171 X |
| 3,016,819 | 1/1962 | Kupka | 100/170 X |
| 3,122,089 | 2/1964 | Sinclair . | |
| 3,154,008 | 10/1964 | Hurter | 100/168 X |
| 3,155,029 | 11/1964 | Thomas | 100/170 |
| 3,158,088 | 11/1964 | Seidel | 100/170 X |
| 3,183,826 | 5/1965 | Moore | 100/170 V |
| 3,270,664 | 9/1966 | Venemann et al. | 100/170 X |
| 3,525,301 | 8/1970 | Justus et al. | 100/161 |
| 3,561,359 | 2/1971 | Cohen | 100/168 X |
| 4,311,091 | 1/1982 | Pav et al. | 100/161 |

FOREIGN PATENT DOCUMENTS

| | | | |
|---|---|---|---|
| 147035 | 9/1936 | Austria | 242/66 |
| 274246 | 6/1913 | Fed. Rep. of Germany . | |
| 629355 | 4/1936 | Fed. Rep. of Germany . | |
| 644119 | 4/1937 | Fed. Rep. of Germany . | |
| 2320518 | 4/1973 | Fed. Rep. of Germany | 100/161 |
| 61181 | 6/1948 | Netherlands | 100/171 |
| 182356 | 2/1936 | Switzerland . | |
| 711599 | 7/1954 | United Kingdom . | |
| 1150651 | 4/1969 | United Kingdom . | |
| 306205 | 3/1968 | U.S.S.R. | 242/55.1 |

*Primary Examiner*—John M. Jillions
*Attorney, Agent, or Firm*—Werner W. Kleeman

[57] ABSTRACT

A wind-up apparatus for forming laps comprises a first winding roller, a second winding roller, a lap bobbin tube and a plurality of, for instance four, calender rolls. The calender rolls serve for consolidating a fiber layer into a windable fiber web. Each calender roll of the predetermined number of calender rolls has a predetermined rest position and an operating position. A guide structure is provided for the calender rolls to enable the calender rolls to be movable within a given mobility range defined between the rest position and the operating position. The guide structure comprises force-producing elements for moving the calender rolls into the predetermined rest position thereof.

12 Claims, 20 Drawing Figures

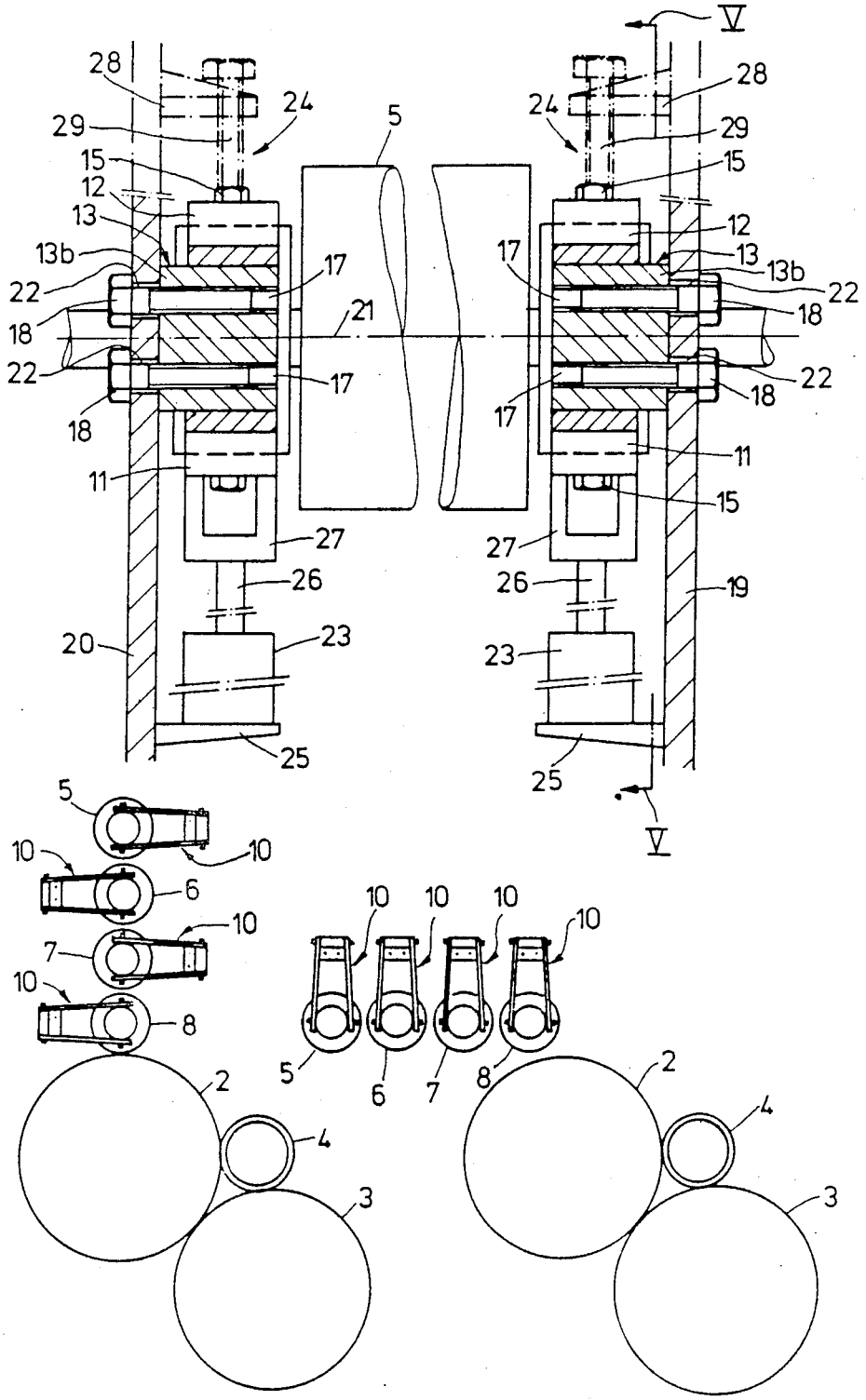
V
28
24
5
29
15
12
13
13b
22
17
21
18
11
27
26
23
20
25
19
10
6
7
8
2
4
3

WINDING APPARATUS FOR FORMING LAPS

CROSS-REFERENCE TO RELATED APPLICATION

This application is a divisional application of our commonly assigned, copending U.S. patent application Ser. No. 06/657,352, filed Oct. 3, 1984, and entitled: "WINDING APPARATUS FOR FORMING LAPS", now U.S. Pat. No. 4,637,565, granted Jan. 20, 1987.

BACKGROUND OF THE INVENTION

The present invention relates to a new and improved winding apparatus for forming laps and which is of the type containing at least one rotating winding roll or roller and a given or predetermined number of calender rolls for compressing a fiber sheet into a windable web (or "sheet").

Laps serve as feed material for ribbon lap machines and for the subsequent combing process.

Calender rolls serve for compressing a fiber web in order to enable unwinding of the lap without mutual felting of the web portions. In order to obtain good fiber web compression, the web should undergo at least two compression stages or operations before there is carried out the formation of the lap.

In order to take up the extension or elongated portion of the web, which arises due to the compression, and in order to obtain a small degree of drafting of the web from one compression passage to another, the circumferential speed of the calender rolls can be slightly increased from calender roll to calender roll.

The aforementioned drafting of the web advantageously takes place with the web lying on the associated calender roll in order to thereby provide the fibers with guidance, that is a so-called stroking effect, and also in order to avoid so-called springing-back (also called breathing), that is to say a partial cancellation of a preceding compression.

Such arrangements of calender rolls have been disclosed in German patent No. 644,119, granted Apr. 8, 1937, and British patent No. 711,599, granted July 7, 1954.

In these patents, the calender rolls are disposed one above the other in a vertical arrangement. It is known that the calender rolls disclosed therein, the shaft bearings of which are guided in slide rails, are supported upon each other with their whole weight.

This arrangement has the disadvantage that during possible idle running of the calender rolls or rollers, that is without a web lying between them, on the one hand, the rollers rub against each other as a function of their different peripheral speeds, and, on the other hand, upon formation of a lap about a calender roll, that is upon occurrence of a defect, the calender rolls must be lifted away from one another in order to free the relevant calender roll of the lap.

In order to eliminate these two disadvantages, or at least to eliminate them to a large extent, an arrangement of calender rolls has been proposed in which two calender roll pairs are arranged next to one another and the aforesaid vertical arrangement is only used per calender roll pair.

Such arrangements are disclosed in U.S. Pat. No. 2,502,894, granted Apr. 4, 1950, and in German patent No. 629,355, granted Apr. 9, 1936.

The advantages achieved by the last-mentioned calender roll arrangement are, however, at least partially obtained by accepting the aforementioned disadvantage that the web no longer is guided in the drafting zone between the two roller pairs, and this, in turn, leads to the aforedescribed "breathing" phenomenon.

SUMMARY OF THE INVENTION

Therefore, it is a primary object of the present invention to provide an improved construction of winding apparatus for forming laps which is not afflicted with the aforementioned drawbacks and shortcomings of the prior art constructions.

Another important object of the present invention aims at the provision of an improved winding apparatus for forming laps, wherein there is provided a simplified construction of the calender rolls and these calender rolls are guided in such a manner as to produce no or practically no friction.

Yet a further important object of the present invention is to provide an improved winding apparatus for laps, wherein a lap forming at one of the calender rolls can be removed without the need for any additional movement of the other calender rolls located in a rest position.

Still a further noteworthy object of the present invention is the provision of an improved winding apparatus for laps which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the winding apparatus of the present invention is manifested by the features that guide means are provided for the calender rolls to enable movement of the calender rolls within a given mobility range. There are also provided means for supporting the guide means in substantially fixed relationship to the at least one rotatable winding roller. The guide means comprise force-producing means for moving the calender rolls into the predetermined rest position.

Certain of the notable advantages achieved by the invention are, on the one hand, the simple construction of the calender rolls and, on the other hand, the guidance of the calender rolls which produces no or practically no friction.

Furthermore, a lap forming about one of the calender rolls can be removed without any additional movement of the calender rolls when they are located in their rest position. Equally, upon start-up of the machine the web can be fed between the first two calender rolls while these calender rolls are stationary, and thereafter can be clamped in the operating position, before the calender rolls are started, through shifting of the calender rolls from their rest position into their operating position.

BRIEF DESCRIPTION OF THE DRAWINGS:

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 2 is an enlarged sectional view of part of the arrangement of FIG. 1, taken substantially along the line I—I thereof;

FIGS. 3 and 4 show two respective further embodiments of the winding apparatus of FIG. 1;

DETAILED DESCRIPTION OF THE PREFERRED EMBODIMENTS

Figure 1:
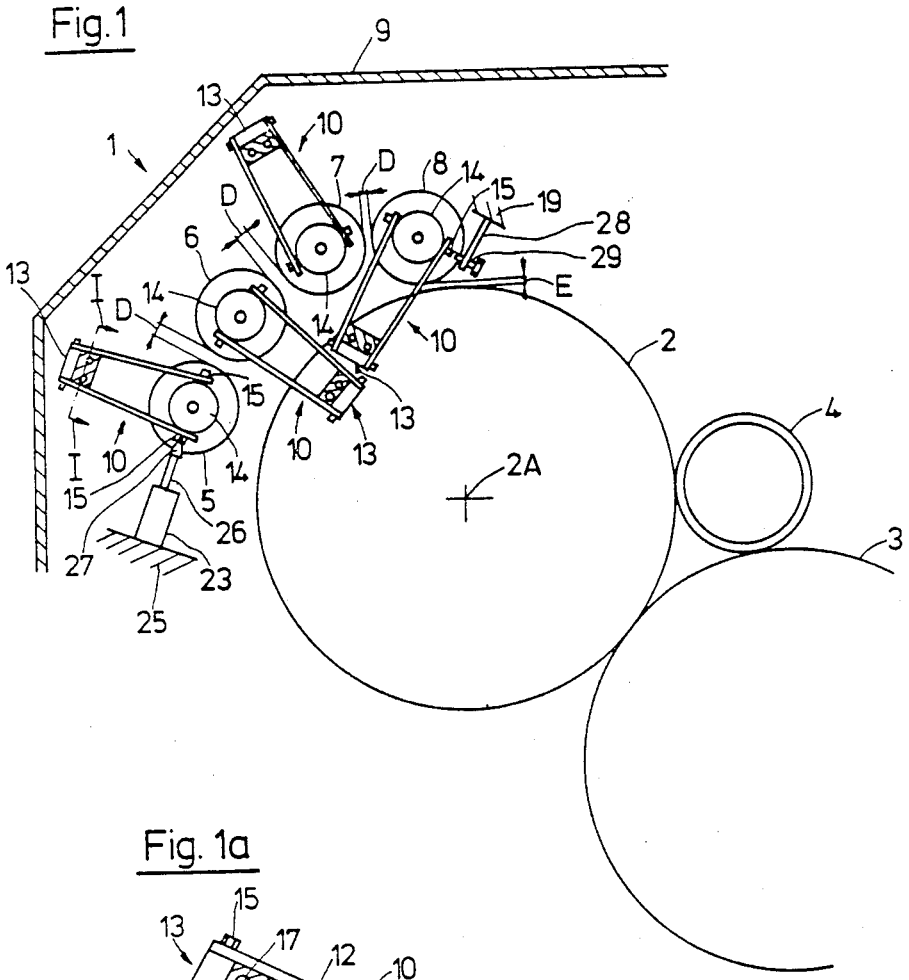
FIG. 1 is a sectional view, partially schematically illustrated, taken along the line V—V of FIG. 2, through a part of a lap winding apparatus equipped with the calender rolls constructed according to the present invention.
Figure 1A:
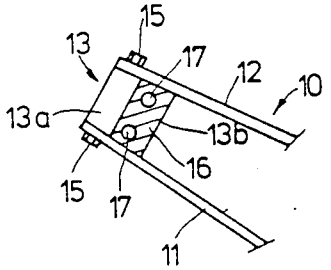
FIG. 1*a* shows a portion of the arrangement of FIG. 1 drawn to a larger scale.

Describing now the drawings, it is to be understood that only enough of the details of the construction of the winding apparatus for forming laps has been shown in the drawings as needed for those skilled in the art to readily understand the underlying principles and concepts of the present development, while simplifying the illustration of the drawings. Turning attention now to FIG. 1, there is illustrated therein a lap winding apparatus 1 which will be seen to comprise a first winding roll or roller 2 and a second winding roll or roller 3 for receiving a lap bobbin tube 4 or the lap (not shown) taken-up on such bobbin tube 4.

Calender rolls or rollers 5 to 8 are arranged before the first winding roll or roller 2, the calender roll 5 being conveniently designated as the first calender roll, the calender roll 6 as the second calender roll, the calender roll 7 as the third calender roll and the calender roll 8 as the last calender roll. The lap winding apparatus 1 is advantageously covered by a hood 9 or other suitable cover or enclosure. These calender rolls 5 to 8 can be arranged in a crescent-shaped manner around the winding roll or roller 2 as shown in FIG. 1 for instance.

The calender rolls 5 to 8 are each carried by means of two spring pairs 10, each such spring pair 10 engaging at one of the opposite or outer ends of the related calender roll 5 to 8. Each such spring pair 10 consists of two spring legs 11 and 12 formed, for instance, as leaf springs. Each spring pair 10 is fixedly connected by means of screws or threaded bolts 15 or the like, on the one hand, to a carrier 13 and, on the other hand, to a supporting member or bearing body 14 receiving an end of the shaft of the related calender roll.

The carrier 13 is divided into a portion 13*a* for receiving the screws or threaded bolts 15 or equivalent fastening devices and a portion 13*b* which is provided with a connector surface 16 and with two screw-threaded holes 17 for receiving screws or threaded bolts 18 (FIG. 2).

By means of these screws or threaded bolts 18 the carrier 13 is secured to the side walls 19 and 20 of the lap winding apparatus 1 such that the connector surfaces 16 bear against these walls. Furthermore, the calender rolls are secured to these walls 19 and 20 by means of these carriers 13 such that the rotation axes 21 of the calender rolls 5 to 8 each lie substantially parallel to the rotational axis 2A of the first winding roller 2.

In each of FIGS. 1 to 4 only one carrier 13 per calender roll is shown.

Furthermore, FIG. 1 shows the calender rolls 5 to 8 in a rest position (also called starting position) in which they have a mutual spacing D of approximately 3 mm. A spacing E provided between the last calender roll 8 and the first winding roll 2 also has a value of approximately 3 mm in this rest position of the calender roll 8.

The invention is, however, not limited to maintenance of this 3 mm distance for the spacings D and E; larger or possibly somewhat smaller spacings can also serve for the aforementioned separation of laps from the calender rolls. In this rest position, there is established an equilibrium condition for each calender roll between the sum of the spring forces at both ends of the calender roll and the weight of the calender roll.

Since the spring legs 11 and 12 are fixedly connected by means of the screws 15 or the like to the carriers or carrier members 13 and the supporting members or bearing bodies 14, as a spring pair they have a "rectangular spring" characteristic known from the theory of strength of materials, that is to say, the bending characteristic corresponds approximately to the bending characteristic of a "rectangular spring".

In order to maintain the above-mentioned equilibrium condition, the positions of the carriers 13 on the side walls 19 and 20 are shifted to an extent such that the desired spacing D has the desired value along the whole length of the related calender roll.

Minor corrections of this position can be subsequently undertaken in that the holes 22 (FIG. 2) required for insertion of the screws or threaded bolts 18 are selected to be somewhat larger in size than the diameter of the screws 18 or the like.

Now in order to shift the calender rolls 5 to 8 from the rest position into a working position, in which they rest against one another without a fiber web layer lying between them and in which the spacing E still has a value of approximately 0.2 mm, on the one hand, there is provided a fluid-operated, for instance a pneumatic cylinder 23 on each side or end of the calender rolls (only one such cylinder is shown in FIG. 1), and, on the other hand, a respective abutment means or stop 24 (indicated with dotted lines in FIG. 2) is provided at each side or end of the calender rolls. These pneumatic cylinders 23 are operatively associated with the first calender roll 5 for selectively displacing the same as will be considered more fully hereinafter.

At each side or end of the calender rolls 5 to 8 the corresponding cylinder 23 bears against a related support or support member 25 secured to the related wall 19 or 20, as shown in FIG. 2. On the other hand, a respective piston head 27, forming part of the piston 26 of the related cylinder 23, engages the related leaf spring 11 associated with the calender roll 5. This piston head 27 is formed so as to possess a substantially U-shape as shown in FIG. 2, in order to be able to rest on the leaf spring 11 on both sides of the screw head of the screw 15.

Each of the abutment means 24 comprises a support 28 secured to the related side wall 19 or 20, as shown in FIG. 2, together with a screw or threaded bolt 29 associated therewith. As can be seen from FIGS. 1 and 2, this screw 29 or the like serves as an abutment by means of which the movement of the last calender roll 8 is stopped in such a manner that the aforesaid spacing E does not become smaller than approximately 0.2 mm in the working position of the calender rolls 5 to 8, i.e. it is maintained at least such that no contact arises between the calender roll 8 and the first winding roll or roller 2. At the same time, the head of the screw 15 of the corresponding spring leg rests against the screw 29. The spacing E can be adapted by suitably turning the screw 29.

FIGS. 3 and 4 show that the use of the spring-type calender roll guide means illustrated in FIG. 1 is not limited to the arrangement of the calender rolls 5 to 8 as illustrated in such FIG. 1, but can be used in a vertical arrangement (FIG. 3) or in a horizontal arrangement (FIG. 4). The calender rolls 5 to 8 in these FIGS. 3 and 4 are numbered in the same sequence as in the arrangement of FIG. 1.

Figure 5:
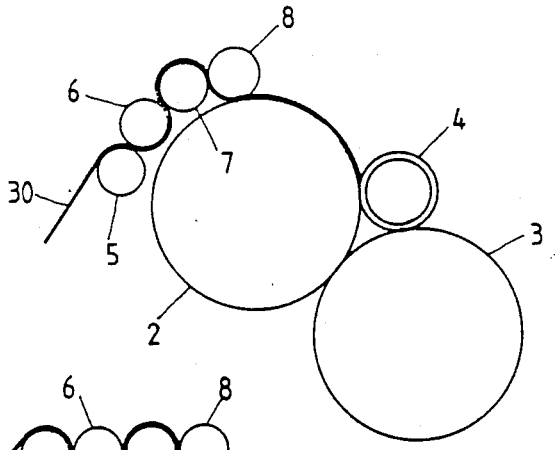
FIGS. 5 to 7 show schematic representations of the winding apparatus of FIGS. 1, 3 and 4 with a web laid thereon.
Figure 6:
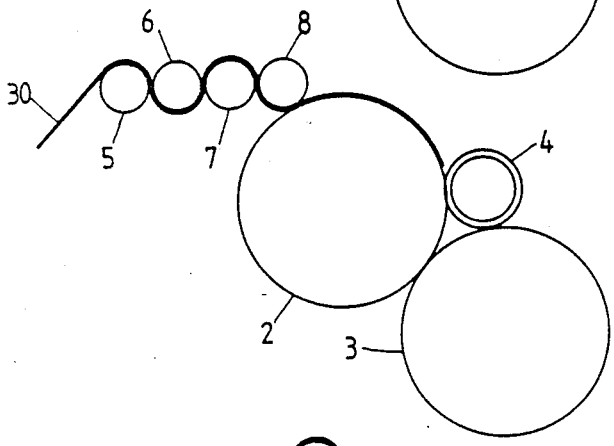
Figure 7:
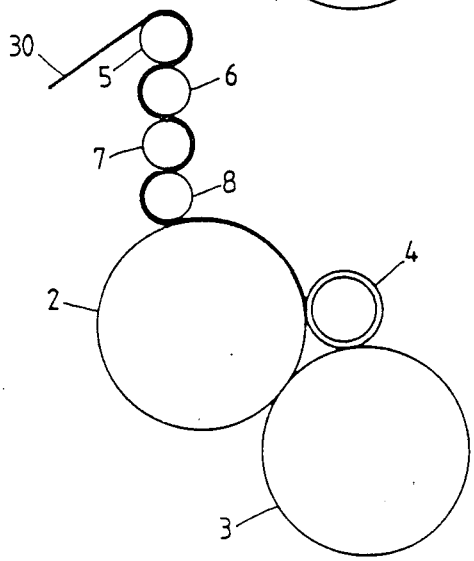

The same applies to FIGS. 5 to 7 which depict the manner in which a web 30 can be passed over the calender rolls 5 to 8 and thereafter over the first winding roll or roller 2 and finally onto the lap bobbin 4.

FIGS. 8 to 11 show modifications of the calender roll guide means according to the invention. Similar or analogous elements have been therefore generally designated with the same reference numerals.

Figure 8:
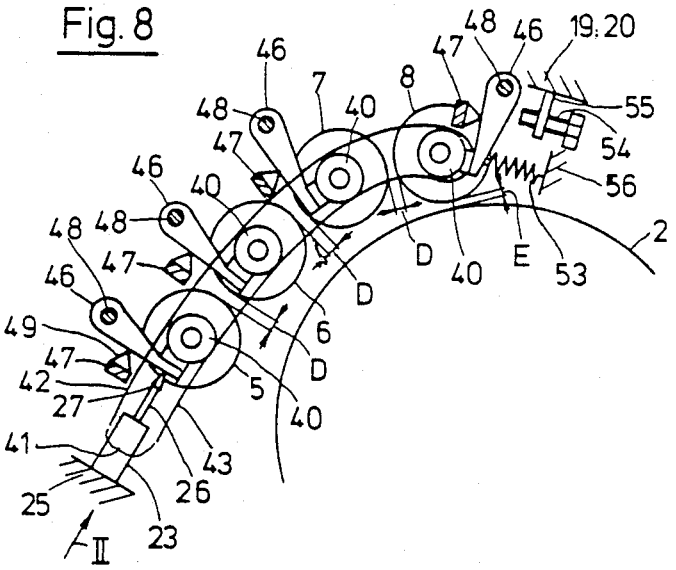
FIG. 8 shows a modification of the calender rolls of the arrangement of FIG. 1.
Figure 8A:
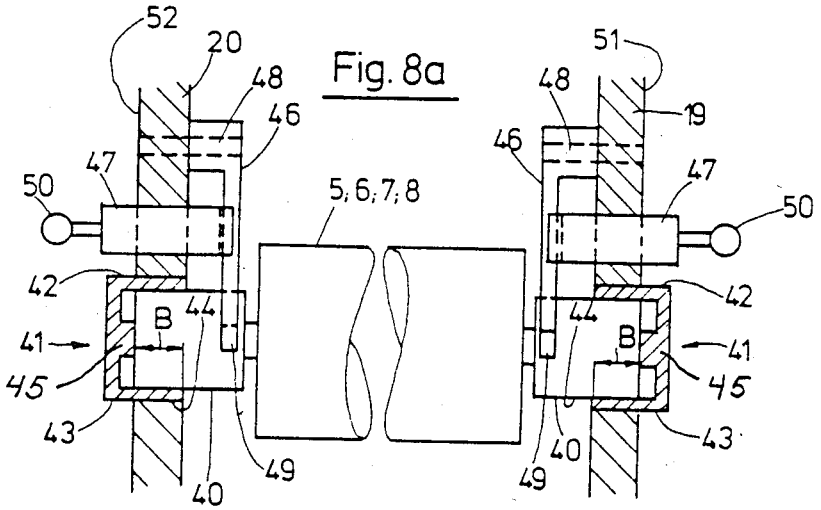
FIG. 8*a* shows in plan and in sectional view and on an enlarged scale a portion of the apparatus of FIG. 8, viewed in the direction of the arrow II of FIG. 8.

In FIG. 8, the support members or bearing bodies 40 are guided in a guide path or track 41 (as shown in FIG. 8*a* and only indicated schematically in FIG. 8) provided at each side or end of the calender rolls 5 to 8 and each consisting of an upper guide rail 42 and a lower guide rail 43.

The circumferential or outer surface 44 of each such support member 40 is correspondingly matched to the guide rails 42 and 43 and is, for example, circular and has a smoothness and width B (FIG. 8*a*) appropriate for enabling a sliding movement to occur between these outer surfaces 44 and the guide rails 42 and 43.

Each such guide path or track 41 comprises an abutment ledge or rail 45 (FIG. 8*a*) in order to stabilize the calender rolls 5 to 8 guided by means of the guide paths or tracks 41 in their longitudinal direction.

In an arrangement of the calender rolls 5 to 8 as shown in FIG. 8, the calender rolls 5 to 7 have, as a result of the action of gravity, the tendency to slide downwards in their guide paths or tracks 41 in a counter-clockwise direction, and the calender roll 8 has the tendency to slide downwards in the guide paths or tracks 41 in a clockwise direction. In order to permit this to occur only to a certain degree, in which the previously mentioned spacings D and the spacing E have a value of approximately 3 mm, the support members or bearing bodies 40 rest against pivot arms or arm members 46, these pivot arms 46 being retained in desired position through their abutting engagement with noses or nose members 49 forming part of related locking bars or locking means 47.

The pivot arms 46 are each pivotally mounted by means of pivot pins 48 or the like in the side walls 19 and 20, and are pivoted in clockwise direction until each guide path or track 41 is free so as to enable leading-in or insertion of the calender rolls 5 to 8 and specifically their support members or bearing bodies 40 into the guide paths or tracks 41. The locking bars 47 are therefore movably guided in the side walls 19 and 20 such that they can be shifted from a starting position, in which the abutment noses 49 engage or bear at the side walls 19 and 20, respectively, into an operating position in which the abutment nose 49, as illustrated in FIG. 8*a*, lies in front of the corresponding pivot arm 46, whereby any return pivoting movement of the pivot arm 46 in clockwise direction is prevented.

The locking bars or locking means 47 (as partially illustrated in FIG. 8*a*) are furthermore provided with a grip or handle 50 (FIG. 8*a*) and an abutment (not shown). The latter serves for facilitating correct positioning of the related locking bar 47 and rests in the working position of the locking bar 47 against the external surface 51 of the side wall 19 or against the external surface 52 of the other side wall 20.

Since the calender roll 8 moves downwards in a clockwise direction in the guide paths or tracks 41, the pivot arms 46 provided on both sides or ends of the calender roll 8 each require two abutments, one of which is the locking bar 47, and each require one spring 53.

Each such spring 53 is a pressure or compression spring supported on a base 56 (indicated only in FIG. 8) forming part of the side walls 19 and 20, and each such spring 53 presses the calender roll 8 in a counter-clockwise direction in the related guide path or track 41 into the rest position in which the pivot arm 46 engages the nose 49 of the associated locking bar 47.

In this rest position of the calender roll 8, the spacing E has a value of approximately 3 mm. As a result of gravity, which tends to shift the calender rolls 5, 6 and 7 in a counter-clockwise direction in the guide paths or tracks 41, the calender rolls 5, 6 and 7 engage the noses or nose members 49 by means of the pivot arms 46 when in the rest position, the spacing or distance between the locking bars 47 being so chosen that in this rest position the spacings or distances D between the calender rolls 5 to 8 have the already mentioned value of approximately 3 mm.

The operating position of the calender rolls 5 to 8 is obtained in the manner described for FIGS. 1 and 2 by means of respective cylinders 23 provided on both sides of the calender rolls. Accordingly, there is no need to further describe these components or elements, particularly since reference can be made to the portion of the corresponding description given for such components of elements with reference to FIGS. 1 and 2. It will be observed that therefore the same components or elements have been generally indicated with the same reference numerals.

In the working position of the calender rolls 5 to 8 of FIG. 8, the pivot arms 46 engage the last calender roll 8 at respective abutment screws 54 to ensure that the spacing E has a value of at least 0.2 mm in this operating position of the calender rolls. In this position, the pivot arms 46 associated with the calender roll 8 no longer rest against the abutment noses 49, which also applies for the pivot arms 46 which are associated with the other calender rolls 5, 6 and 7.

Each abutment screw 54 is connected with the side wall 19 or 20 by means of a support 55 in which a screw thread for receiving this screw 54 is provided, that is to say, on each side of the calender roll a pivot arm 46, a locking bar 47, a spring 53 and an abutment screw 54 are provided.

Figure 9:
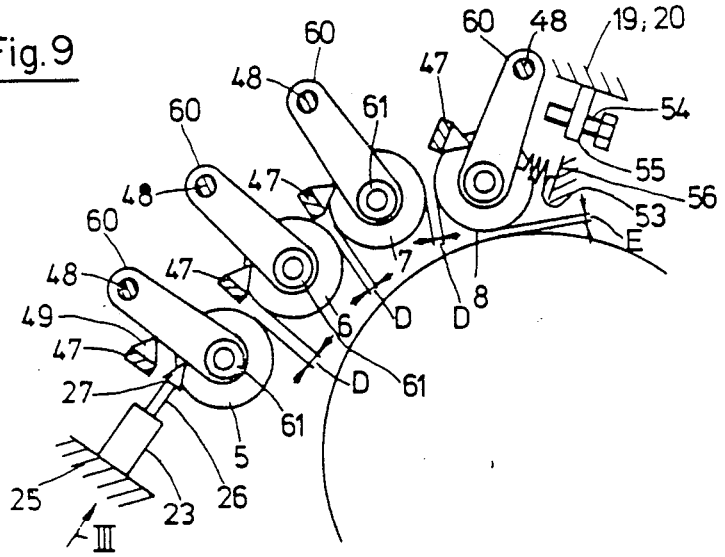
FIG. 9 shows a further modification of the calender rolls of the arrangement of FIG. 1.
Figure 9A:
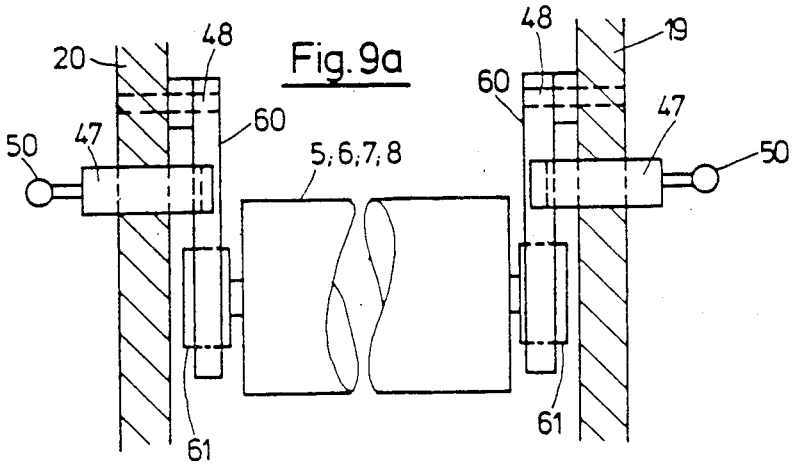
FIG. 9*a* shows in plan and in sectional view and on an enlarged scale a portion of the apparatus of FIG. 9, viewed in the direction of the arrow III of FIG. 9.

FIGS. 9 and 9*a* show a further modification similar to the modification of FIGS. 8 and 8*a*, in which the calender rolls 5 to 8 move in the same manner as a result of gravity, and are retained in the same manner by abutments and moved in the same manner by springs. Accordingly, elements performing the same functions have been conveniently designated with the same reference numerals as used in the descriptions of the preceding figures.

The essential difference over the arrangement illustrated in FIGS. 8 and 8*a* resides in the guidance of the calender rolls 5 to 8 in that these are pivotally mounted by means of pendulum arms or arm members 60. The pendulum arms 60 are pivotally mounted on the side walls 19 and 20 by means of pivot pins 48 and receive the support members or bearing bodies 61 of the calender rolls 5 to 8. The locking bars 47, the retaining screws 54, the pressure springs 53 and the cylinders 23 with associated auxiliary equipment have the same functions as in the arrangement illustrated in FIGS. 8 and 8*a*. Accordingly, the pendulum arms 60 associated with the calender roll 8 engage the noses 49 of the locking bar 47 when in the rest position as a result of the spring pressure of the springs 53. Simultaneously, the pendulum arms 60 associated with the calender rolls 5, 6 and 7 engage with the corresponding noses 49 of the locking bar 47 as a result of the weight of these calender rolls 5 to 7. In this rest position the spacings or distances D and the spacing E have the previously mentioned value of approximately 3 mm.

Shifting out of this rest position into the operating position in which the calender rolls 5 to 8 engage each other in the absence of a fiber web is effected, as described for the arrangements of FIGS. 1 and 8, by means of the pneumatic cylinders 23.

Figure 10:
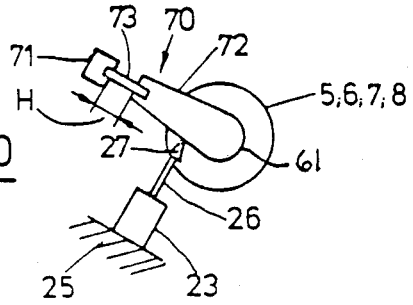
FIG. 10 shows a modification of the calender roll of the arrangement of FIG. 9.

FIG. 10 shows a further modification of the calender roll guidance in which each of the support members or bearing bodies 61 are received by a related spring arm 70. This spring arm 70 comprises a carrier beam 71 secured in any appropriate manner to the side walls 19 and 20, a support arm 72 and a leaf spring 73 connecting the support arm 72 to the carrier beam 71.

The use of this spring arm 70 can be effected in the following two different manners in dependence upon the choice of the bending strength of the leaf spring 73.

1st manner:

The leaf spring 73 has a bending strength which corresponds to that of the spring pair 10 of the arrangement of FIG. 1. It follows that the spring arm 70 can be used in the manner described for FIG. 1.

2nd manner:

The leaf spring 73 is chosen in respect of bending strength only such that it produces a bendable connection between the carrier beam 71 and the support arm 72, without being able to compensate the moment produced by the weight of the calender rolls. It follows that the spring arm 70 is used under the following conditions in the manner described for FIG. 9.

The spacing H must have such a relation to the thickness of the leaf spring 73 that substantially no diversion or buckling of the leaf spring 73 is produced by the support of the calender rolls on the noses 49. The term "diversion" refers to bending or buckling of the leaf spring 73 which can arise if the mutually opposing surfaces of the carrier beam 71 and the spring arm 70 shift relative to one another.

Figure 11:
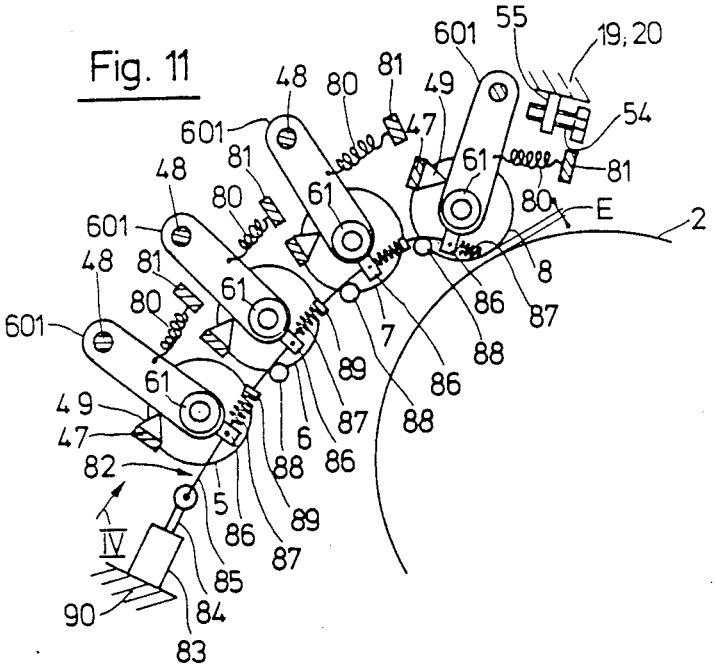
FIG. 11 shows yet a further modification of the calender rolls of the arrangement of FIG. 1.
Figure 11A:
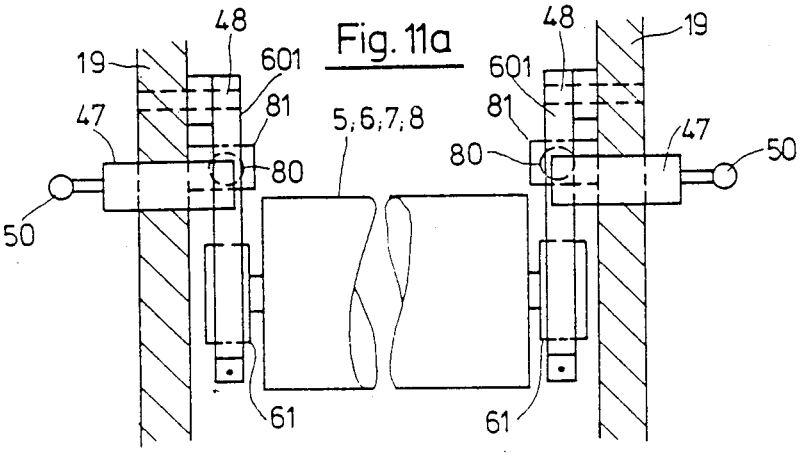
FIG. 11*a* shows in plan and in sectional view and on an enlarged scale a portion of the apparatus of FIG. 11, viewed in the direction of the arrow IV of FIG. 11.

FIGS. 11 and 11*a*—or 11*b*—finally show a modification in the use of pendulum arms 601 which correspond to the pendulum arms 60 of FIGS. 9, but which are used when fitted with an additional part still to be described. Further, in this modification the locking bar or locking means 47 and the abutment screw 54 are also used in the same manner as has been described with reference to FIGS. 8 and 9. The essential difference in the technique used in this arrangement compared to the arrangement illustrated and described with reference to FIGS. 1 and 8 and 9 is that the movement of the calender rolls 5 to 8 from the rest position into the operating position is not effected by the pneumatic cylinders 23 but by tension springs 80 which are connected, on the one hand, to their related pendulum arm 601 and, on the other hand, to pillars or posts 81 secured to the side walls 19 and 20. Each tension spring 80 is so dimensioned that it is able to pivot the calender rolls 5 to 8 from the rest position into the operating position. In this operating position the pendulum arm 601 of the calender roll 8 engages the abutment screw 54. As described for the arrangement of FIGS. 1, 8 and 9 the elements are also provided on both sides of the calender rolls in the arrangement illustrated in FIG. 11. In the following, this double-sided arrangement is described briefly:

Pivoting of the pendulum arms 601 from the operating position into the rest position, in which the pendulum arms 601 engage the abutment noses 49 of the locking bars or locking means 47, is effected by means of a cable drive 82. This cable drive 82 comprises a pneumatic cylinder 83 secured on a base 90 forming part of each of the walls 19 and 20, respectively, together with a piston 84 to which a tension cable 85 is secured.

This tension cable 85 is guided from the piston 84 through eyes or eyelets 86 provided on the pendulum arms 601 and through a compression spring 87 provided after each eye 86 and is also guided over rollers 88 respectively mounted between the compression springs 87 and the eyes 86. The end of the cable 85 remote from the piston 84 is connected to the end of the last compression spring 87 remote from the eye 86.

Between each compression spring 87 and roller 88 there is located a connector 89 fixedly secured to the tension cable 85.

The length of the piston stroke must be somewhat greater, for example 5 mm, than the sum of all spacings D (cf. FIGS. 1, 8, 9) and the spacing E, which are not illustrated in FIG. 11 for the sake of preserving clarity of this figure.

Figure 11B:
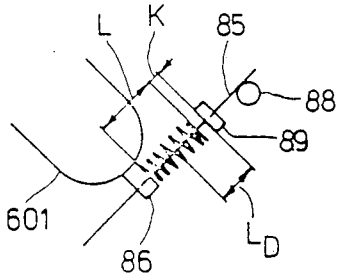
FIG. 11*b* shows on an enlarged scale a portion of the apparatus of FIG. 11.

The spring characteristic (that is the relation between the change in the extension or length of the spring and the change in the spring force) of the springs 87 must be so chosen that their length LD (FIG. 11*b*) to which they can be compressed satisfies the following conditions:

1. The length LD of the last spring 87, that is the spring 87 associated with the calender roll 8, must correspond to at least three times the spacing D, and
2. the length LD of the second last spring 87 must correspond to twice the spacing D,
3. the length LD of the third last spring must correspond to the spacing D, while
4. for the first spring (or fourth-last spring) 87 the length LD can be zero. This latter condition would imply that the spring 87 of the first calender roll 5 could be omitted and the connector 89 can be so positioned that when the pendulum arm 601 engages the first nose 49 the connector engages the eye 86.

On the other hand, the first spacing K (FIG. 11*b*) between the first spring 87, that is the spring 87 associated with the calender roll 5, and the first connector 89 must correspond to three-times the spacing D, the second spacing K must correspond to twice the spacing D and the third spacing K must correspond to the spacing D. The fact that the last or fourth spacing K is zero results from the fact that the end of the cable 85 is connected to the end of the compression spring 87 remote from the eye 86.

Further, the spring forces of the compression springs 87 must be larger than the spring forces of the tension springs 80 so that shifting of the calender rolls 5 to 8 from the operating into the rest position is ensured.

Figure 12:
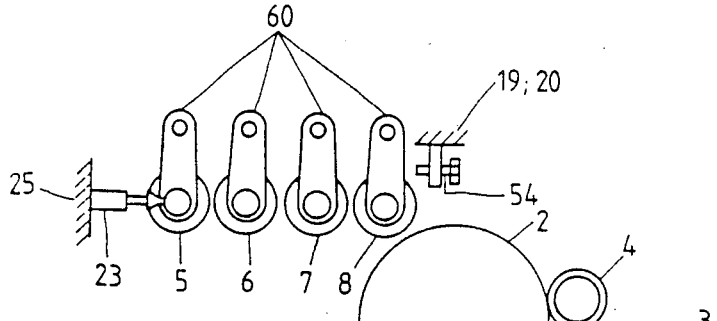
FIG. 12 shows a further modification of the arrangement of FIG. 9, illustrated schematically and on a smaller scale.

The advantage of the arrangement illustrated in FIG. 11 is that the contact pressure between the calender rolls 5 to 8 can be chosen to correspond to the selection of the tension spring characteristic. FIG. 12 represents a modification of FIG. 9 and since it relates merely to another arrangement of the same elements, the elements have been generally provided with the same reference numerals as used in connection with the arrangement of FIG. 9.

In this arrangement, the calender rolls 5 to 8 are arranged so as to be freely suspended in the rest position by means of the pendulum arms 60.

In order to shift the calender rolls 5 to 8 into the previously described operating position the pneumatic cylinder 23 is activated, as described with reference to FIG. 9, until all calender rolls 5 to 8 engage each other and the pendulum arm 60 associated with the calender roll 8 engages the abutment screw 54 in order to bring the spacing E (already described and not additionally indicated here) to the desired value of approximately 0.2 mm.

Figure 13:
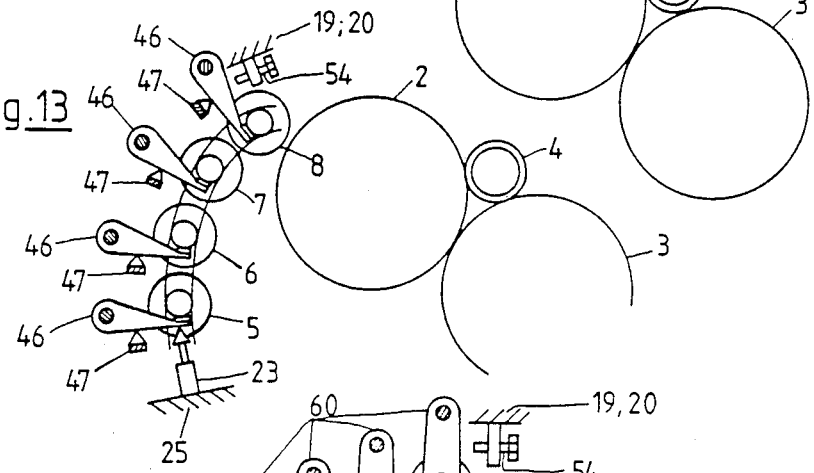
FIG. 13 shows a modification of the arrangement of FIG. 8, illustrated schematically and on a smaller scale.

FIG. 13 illustrates a modification of the arrangement illustrated in FIG. 8 insofar as the therein depicted guide path or track 41 is here shifted so far downwardly that all calender rolls 5 to 8 riding in this guide path or track 41 slide downwardly in the same direction along such guide path by reason of their weight. In this way the compression spring 53 shown in FIG. 8 can be omitted. Since the elements are the same as those illustrated and described with reference to FIG. 8, the same reference numerals have also here been generally used in this FIG. 13.

Figure 14:
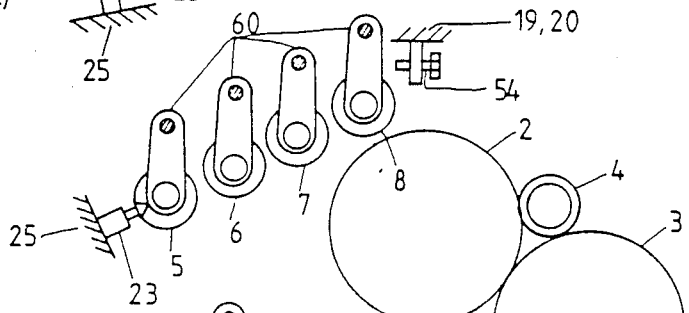
FIG. 14 shows in schematic illustration a modification of the arrangement of FIG. 12.

The modification illustrated in FIG. 14 relates to an arrangement similar to that of FIG. 12 with the single difference that the calender rolls 5 to 8 are not arranged in a horizontal line but in an upwardly inclined or sloping line. The advantage of this arrangement, as compared with that of FIG. 12, is that it is more economical as to the spatial requirements. The elements involved are the same as those shown in FIGS. 9 and 12 so that also here the same reference numerals have been generally used.

Figure 15:
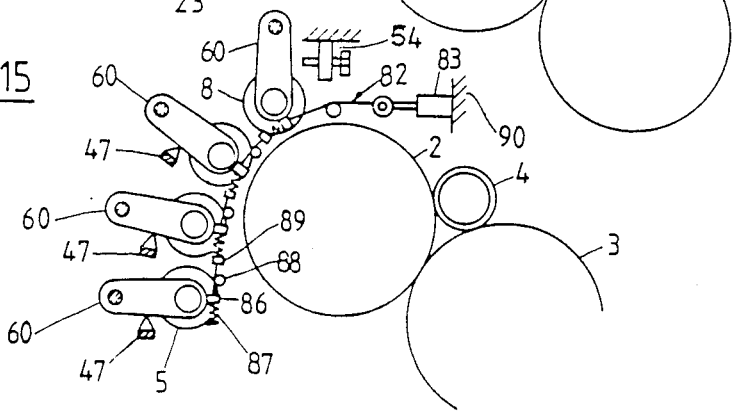
FIG. 15 shows a modification of the arrangement of FIG. 11, illustrated schematically and on a smaller scale.

Finally, FIG. 15 shows a modification of the arrangement illustrated in FIG. 11 insofar as, on the one hand, the cable drive 82 draws the calender rolls 5 to 8 from their rest position into their operating position and, on the other hand, the last calender roll 8 is arranged so as to be freely suspended. This new arrangement has the advantage in comparison with that of FIG. 11 that the tension springs 80 can be omitted.

The cable drive 82 has a cable 85, tension springs 87, rollers 88 and connectors 89 in exactly the same way as was described previously for the arrangement of FIG. 11.

Furthermore, the spacings described for FIG. 15 are provided in the same sense between the connectors 89 and the compression springs 87.

Finally, also in this FIG. 15 the calender rolls 5 to 8 are in the operating position when all calender rolls engage one another and the pendulum arms 60 associated with the last calender roll engage the retaining screw 54.

Since also in this FIG. 15 the elements are the same as those for the arrangement described with reference to FIG. 11, the same reference numerals have been generally used and for clarity of illustration certain reference numerals have even been omitted.

While there are shown and described present preferred embodiments of the invention, it is to be distinctly understood that the invention is not limited thereto, but may be otherwise variously embodied and practiced within the scope of the following claims. Accordingly,

What is claimed is

1. A wind-up apparatus for forming textile fiber laps, comprising:

at least one rotatable winding roller;

a predetermined number of calender rolls associated with said at least one rotatable winding roller and serving for consolidating a fiber layer into a windable fiber lap;

each calender roll of said predetermined number of calender rolls having a predetermined rest position and an operating position;

one of said predetermined number of calender rolls being arranged for cooperation with said at least one rotatable winding roller;

said one calender roll, in said rest position thereof, being arranged at a first predeterminate spacing from said at least one rotatable winding roller;

said one calender roll, in said operating position thereof, being arranged at a second predeterminate spacing from said at least one rotatable winding roller such that there is no contact between said one calender roll and said at least one rotatable winding roller in the absence of said fiber lap;

means operatively associated with said one calender roll and determining said second predeterminate spacing between said at least one rotatable winding roller and said one calender roll in said operating position of said one calender roll;

guide means provided for said calender rolls to enable said calender rolls to be movable within a given mobility range defined between said rest position and said operating position;

means for supporting said guide means and arranged in substantially fixed relationship to said at least one rotatable winding roller; and said guide means comprising force-producing means for moving the calender rolls into said predetermined rest position thereof.

2. The wind-up apparatus as defined in claim 1, wherein:

said guide means comprises a combination of guide elements and force-producing means.

3. The wind-up apparatus as defined in claim 2, wherein:

said guide elements comprise guide track means for guiding the calender rolls;

said guide elements further comprising for each calender roll two pivotable arms for supporting the associated calender roll in its predetermined rest position; and retaining means provided for selectably retaining said two pivotable arms in a roll-supporting position for supporting said associated calender roll in its predetermined rest position.

4. The wind-up apparatus as defined in claim 1, wherein:

the guide means comprise guide elements constituted by pendulum arms for receiving the calender rolls; and retaining means for positioning said pendulum arms in order to position the calender rolls in their predetermined rest position.

5. The wind-up apparatus as defined in claim 1, wherein:

the force-producing means for moving the calender rolls into their predetermined rest position are constituted by the weight of the individual calender rolls.

6. The wind-up apparatus as defined in claim 1, wherein:

said force producing means comprises a force-producing element operatively associated with said one calender roll;

said force-producing element constituting at least one spring for moving said one calender roll into its predetermined rest position; and the force-producing means for moving remaining ones of said predetermined number of the calender rolls into their predetermined rest position are constituted by the weight of the calender rolls.

7. The wind-up apparatus as defined in claim 1, wherein:

the force-producing means for moving the calender rolls into their rest position comprise a cable; and drive means for operating said cable.

8. The wind-up apparatus as defined in claim 7, wherein:

said drive means comprises a pneumatic cylinder.

9. The wind-up apparatus as defined in claim 4, wherein:

said one calender roll is received by two pendulum arms;

said force-producing means comprising force-producing elements operatively associated with said one calender roll; and said two force-producing elements being constituted by two springs each acting on one of said two pendulum arms.

10. The wind-up apparatus as defined in claim 1, wherein:

said means operatively associated with said one calender roll comprising retaining means for determining said second predeterminate spacing.

11. The wind-up apparatus as defined in claim 1, wherein:

the calender rolls when in their predetermined rest position have a mutual spacing from one another;

said one calender roll which cooperates with the at least one rotatable winding roller, has a spacing from the at least one winding roller in the order of 2 to 5 mm in said predetermined rest position of said one roll.

12. The wind-up apparatus as defined in claim 11, wherein:

the spacing of said one calender roll in said predetermined rest position thereof, from the at least one rotatable winding roller amounts to approximately 3 mm.

* * * * *